US008755557B2

(12) United States Patent
Fujitani et al.

(10) Patent No.: US 8,755,557 B2
(45) Date of Patent: Jun. 17, 2014

(54) LOUDSPEAKER DIAPHRAGM AND LOUDSPEAKER INCLUDING THE LOUDSPEAKER DIAPHRAGM

(75) Inventors: Takeshi Fujitani, Neyagawa (JP); Yushi Ono, Neyagawa (JP); Ryoichi Takahashi, Yokohama (JP); Ryosuke Sano, Yokohama (JP)

(73) Assignee: Onkyo Corporation, Osaka (JP)

( * ) Notice: Subject to any disclaimer, the term of this patent is extended or adjusted under 35 U.S.C. 154(b) by 123 days.

(21) Appl. No.: 13/167,215

(22) Filed: Jun. 23, 2011

(65) Prior Publication Data

US 2011/0317869 A1 Dec. 29, 2011

(30) Foreign Application Priority Data

Jun. 25, 2010 (JP) ..... 2010-144605

(51) Int. Cl.
*H04R 25/00* (2006.01)

(52) U.S. Cl.
USPC ..... 381/398; 181/167; 381/426

(58) Field of Classification Search
CPC ..... H04R 7/20; H04R 2307/207; H04R 2307/204; H04R 2231/001
USPC ..... 181/167, 169, 171; 381/398, 396, 423
See application file for complete search history.

(56) References Cited

U.S. PATENT DOCUMENTS 5,099,949 A * 3/1992 Mitobe ..... 181/171
5,283,027 A * 2/1994 Sakamoto et al. ..... 264/320
5,521,886 A * 5/1996 Hirosawa et al. ..... 367/174
5,608,810 A * 3/1997 Hall ..... 381/398
6,183,674 B1 * 2/2001 Nonogaki ..... 264/46.4
7,711,138 B2 * 5/2010 Howze ..... 381/398
7,980,355 B2 * 7/2011 Tokura et al. ..... 181/171
8,023,687 B2 * 9/2011 Matsuda et al. ..... 381/398
2008/0205688 A1 * 8/2008 Sato ..... 381/400

FOREIGN PATENT DOCUMENTS

JP 7-015793 A 1/1995
JP 2004-274661 A 9/2004
JP 2008-271342 A 11/2008

OTHER PUBLICATIONS

Japanese Office action for Application No. 2010-144605 dated Nov. 7, 2013.

* cited by examiner

*Primary Examiner* — Davetta W Goins
*Assistant Examiner* — Phylesha Dabney
(74) *Attorney, Agent, or Firm* — Pearne & Gordon LLP

(57) ABSTRACT

A loudspeaker diaphragm according to an embodiment of the present invention includes: a diaphragm portion; and an edge portion, which is molded integrally with the diaphragm portion and made of a material different from a material for the diaphragm portion, wherein: the diaphragm portion includes, at an outer peripheral end thereof, an outer wall portion provided upright in a direction substantially parallel to a vibrating direction of the diaphragm portion; an inner peripheral surface of the edge portion is bonded onto an outer peripheral surface of the outer wall portion; and the outer wall portion has a height larger than a thickness of the diaphragm portion.

7 Claims, 7 Drawing Sheets

LOUDSPEAKER DIAPHRAGM AND LOUDSPEAKER INCLUDING THE LOUDSPEAKER DIAPHRAGM

This application claims priority under 35 U.S.C. Section 119 to Japanese Patent Application No. 2010-144605 filed on Jun. 25, 2010, which are herein incorporated by references.

BACKGROUND OF THE INVENTION

1. Field of the Invention

The present invention relates to a loudspeaker diaphragm and a loudspeaker including the loudspeaker diaphragm.

2. Description of the Related Art

In general, a vibration system member, such as a loudspeaker diaphragm to be used in a loudspeaker, is obtained by assembling respective members, such as a diaphragm, an edge, and a gasket each molded into a predetermined shape, using an adhesive. The vibration system member thus obtained has a problem in that poor bonding may be caused depending on the combination of the respective members, and a problem in that characteristics may fluctuate due to a variation in adhesive application amount. Further, in order to prevent an operation failure of the loudspeaker, it is necessary to use a highly-accurate assembly jig, which leads to a problem of poor productivity. In addition, in a case of using a less adhesive material (for example, olefin-based thermoplastic resin), a process such as primer application is further required prior to adhesive application, which leads to problems with productivity and production cost.

In order to solve the above-mentioned problems, a method of molding the diaphragm, and the edge and the gasket by double molding has been proposed (Japanese Patent Application Laid-open No. Hei 7-15793). However, a bonding portion between the diaphragm and the edge has low strength and low rigidity, and hence there is a problem in that the diaphragm and the edge cause divided vibration.

SUMMARY OF THE INVENTION

The present invention has been made to solve the above-mentioned conventional problems, and an object of the present invention is therefore to provide a loudspeaker diaphragm capable of suppressing occurrence of divided vibration and provide a loudspeaker including the loudspeaker diaphragm.

A loudspeaker diaphragm according to an embodiment of the present invention includes: a diaphragm portion; and an edge portion, which is molded integrally with the diaphragm portion and made of a material different from a material for the diaphragm portion, wherein: the diaphragm portion includes, at an outer peripheral end thereof, an outer wall portion provided upright in a direction substantially parallel to a vibrating direction of the diaphragm portion; an inner peripheral surface of the edge portion is bonded onto an outer peripheral surface of the outer wall portion; and the outer wall portion has a height larger than a thickness of the diaphragm portion.

In a preferred embodiment of the present invention, the diaphragm portion comprises a voice coil guide portion extending below the outer wall portion.

In a preferred embodiment of the present invention, the diaphragm portion includes a polyolefin-based thermoplastic resin and one of an inorganic filler and grain.

In a preferred embodiment of the present invention, the edge portion has a JIS-A hardness of 0° to 70°.

In a preferred embodiment of the present invention, the loudspeaker diaphragm further includes a gasket portion which is made of the same material as the material for the diaphragm portion and molded integrally with and bonded to an outer peripheral portion of the edge portion.

In a preferred embodiment of the present invention, the outer wall portion comprises a protruding portion protruding in a radial direction; and the protruding portion comprises a plurality of protruding portions provided at substantially equal intervals in a circumferential direction of the outer wall portion.

In a preferred embodiment of the present invention, the diaphragm portion and the edge portion are obtained by being molded integrally with each other by double molding.

According to another aspect of the present invention, a loudspeaker is provided. The loudspeaker of the present invention includes the loudspeaker diaphragm of the present invention; and a voice coil fitted to the voice coil guide portion.

According to the present invention, the diaphragm portion of the loudspeaker diaphragm includes, at the outer peripheral end thereof, the outer wall portion provided upright in the direction substantially parallel to the vibrating direction of the diaphragm portion, and the outer peripheral surface of the outer wall portion and the inner peripheral surface of the edge portion are bonded to each other. Thus, it is possible to provide the loudspeaker diaphragm excellent in strength of the bonding portion and capable of suppressing the occurrence of divided vibration and provide the loudspeaker including the loudspeaker diaphragm.

DETAILED DESCRIPTION OF THE PREFERRED EMBODIMENTS

A. Loudspeaker Diaphragm and Entire Structure of Loudspeaker

Figure 1A:
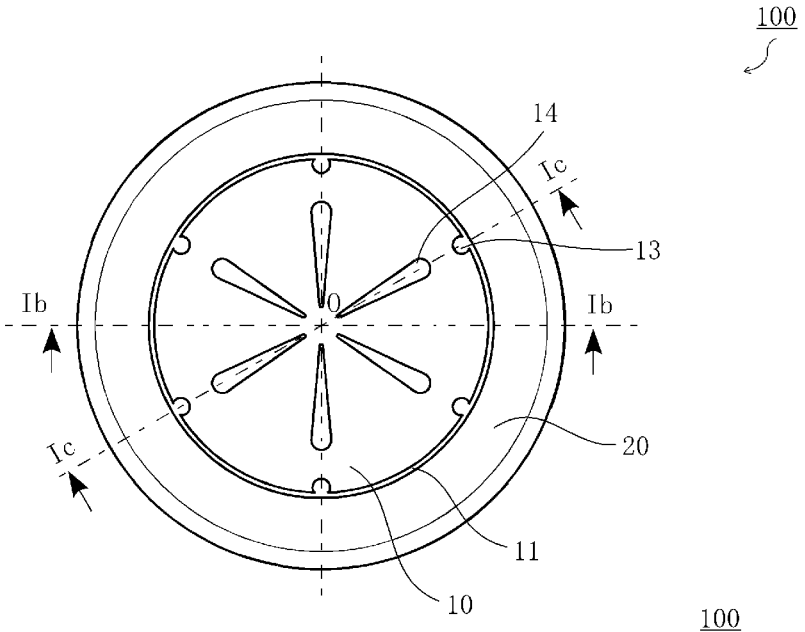
FIG. 1A is a schematic plan view of a loudspeaker diaphragm according to a preferred embodiment of the present invention.
Figure 1B:
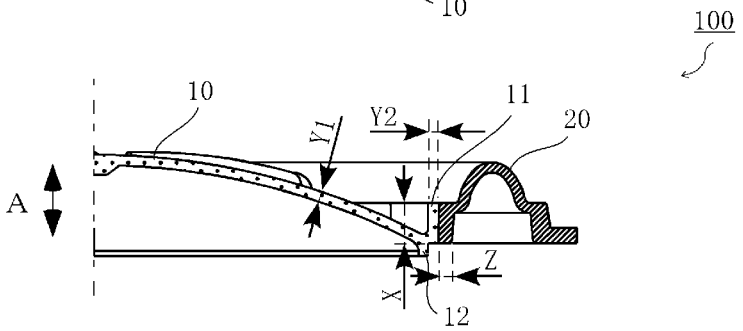
FIG. 1B is a cross-sectional view of a main part of the loudspeaker diaphragm taken along the line Ib-Ib of FIG. 1A.
Figure 1C:
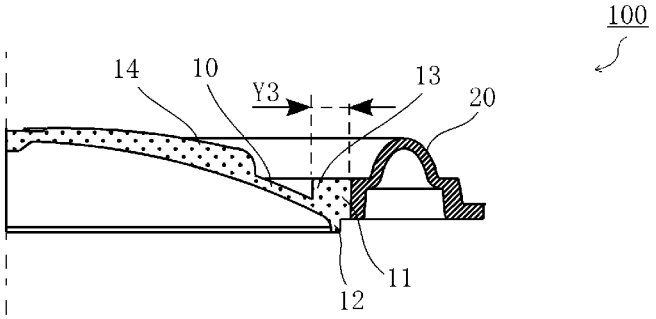
FIG. 1C is a cross-sectional view of a main part of the loudspeaker diaphragm taken along the line Ic-Ic of FIG. 1A.

FIG. 1A is a schematic plan view of a loudspeaker diaphragm according to a preferred embodiment of the present invention. FIG. 1B is a cross-sectional view of a main part of the loudspeaker diaphragm taken along the line Ib-Ib of FIG. 1A. FIG. 1C is a cross-sectional view of a main part of the loudspeaker diaphragm taken along the line Ic-Ic of FIG. 1A. It should be noted that FIG. 1B and FIG. 1C omit illustration of a left half of the loudspeaker diaphragm, which is symmetrical to a right half thereof with respect to a center axis passing a point O, and that FIG. 1A has a scale different from scales of FIG. 1B and FIG. 1C. A loudspeaker diaphragm 100 includes a diaphragm portion 10 and an edge portion 20 made of a material different from a material for the diaphragm portion 10. The edge portion 20 is bonded to an outer peripheral portion of the diaphragm portion 10. The diaphragm portion 10 includes, at an outer peripheral end thereof, a tubular outer wall portion 11 provided upright in a direction substantially parallel to a vibrating direction A of the diaphragm portion 10 (hereinafter, simply referred to as vibrating direction A). The diaphragm portion 10 and the edge portion 20 are bonded to each other so that an outer peripheral surface of the outer wall portion 11 and an inner peripheral surface of the edge portion 20 are held in close contact with each other. Further, a height X of the outer wall portion 11 is larger than a thickness Y1 of the diaphragm portion.

As described above, the outer wall portion 11 of the diaphragm portion 10 is provided upright in the direction substantially parallel to the vibrating direction A. Therefore, a direction of a bonding surface of a bonding portion between the diaphragm portion 10 and the edge portion 20 is substantially parallel to the vibrating direction A. Owing to such bonding between the diaphragm portion 10 and the edge portion 20, the edge portion 20 is less likely to be affected by the vibration of the diaphragm portion 10, and the height X of the outer wall portion is larger than the thickness Y1 of the diaphragm portion. Thus, the bonding portion formed on the outer peripheral surface of the outer wall portion 11 is excellent in bonding strength. As a result, antiresonance in the diaphragm portion 10 and the edge portion 20 is suppressed, and hence it is possible to obtain a loudspeaker diaphragm having less divided vibration.

As described above, the height X of the outer wall portion 11 is larger than the thickness Y1 of the diaphragm portion. In one embodiment, the thickness Y1 of the diaphragm portion 10 except a portion in which the outer wall portion 11 and a rib 14 are formed is preferably 0.1 mm to 0.3 mm. Regarding the thickness of the above-mentioned outer wall portion 11, a thickness Y2 of a portion in which no protruding portion is formed is preferably 0.1 mm to 0.3 mm in a radial direction, and a thickness Y3 of a portion in which a protruding portion 13 is formed is preferably 0.5 mm to 0.7 mm in the radial direction. The height X of the above-mentioned outer wall portion 11 is preferably 0.5 mm to 1 mm, more preferably 0.75 mm to 1 mm. Note that, a thickness Z of the edge portion 20 is preferably 0.1 mm to 0.3 mm.

The diaphragm portion 10 preferably includes a voice coil guide portion 12 extending below the outer wall portion 11. The voice coil guide portion 12 is provided as a part of the diaphragm portion 10. When the voice coil guide portion 12 is provided at such a position, a voice coil may be arranged at a position close to the bonding portion between the diaphragm portion 10 and the edge portion 20, and hence it is possible to obtain a loudspeaker having less divided vibration. In one embodiment, as in the illustrated example, the voice coil guide portion 12 extends below the outer wall portion 11 on an inner side (center side) with respect to the outer peripheral surface of the outer wall portion 11, and is formed so that a step is provided between the outer peripheral surface of the outer wall portion 11 and the voice coil guide portion 12. Provision of this step allows easy attachment and fixation of the voice coil.

As illustrated in FIG. 1A, the above-mentioned outer wall portion 11 may include the protruding portion 13 protruding in the radial direction. The protruding portion 13 may protrude inward or outward in the radial direction, or may protrude both inward and outward in the radial direction. As in the illustrated example, the protruding portion 13 preferably protrudes inward in the radial direction. When the protruding portion 13 is provided, it is easy to perform releasing from a die after molding. A plurality of protruding portions 13 may be provided at substantially equal intervals in a circumferential direction of the outer wall portion 11 of the diaphragm portion 10. In one embodiment, six protruding portions 13 are provided at intervals of 60° in the circumferential direction.

The diaphragm portion 10 may include, on its surface, the solid rib 14 that is formed radially from the center side to the outer side of the diaphragm portion 10. The plurality of ribs 14 may be arranged at positions corresponding to the above-mentioned protruding portions 13.

Figure 2A:
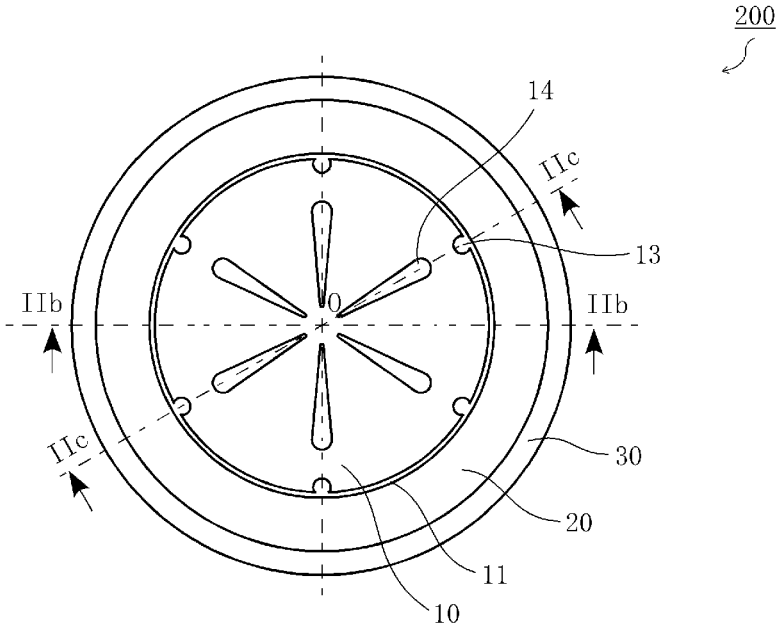
FIG. 2A is a schematic plan view of a loudspeaker diaphragm according to another preferred embodiment of the present invention.
Figure 2B:
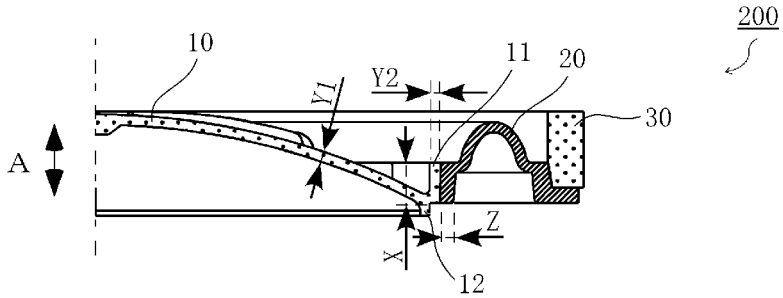
FIG. 2B is a cross-sectional view of a main part of the loudspeaker diaphragm taken along the line IIb-IIb of FIG. 2A.
Figure 2C:
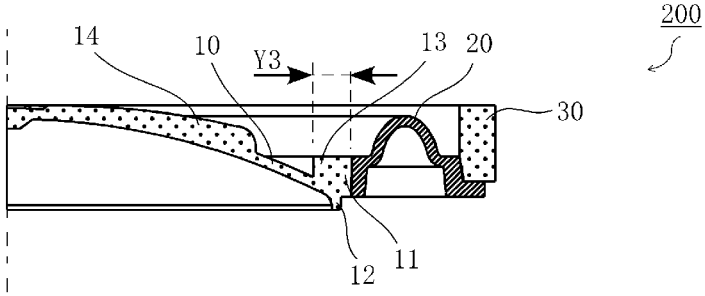
FIG. 2C is a cross-sectional view of a main part of the loudspeaker diaphragm taken along the line IIc-IIc of FIG. 2A.

FIG. 2A is a schematic plan view of a loudspeaker diaphragm according to another preferred embodiment of the present invention. FIG. 2B is a cross-sectional view of a main part of the loudspeaker diaphragm taken along the line IIb-IIb of FIG. 2A. FIG. 2C is a cross-sectional view of a main part of the loudspeaker diaphragm taken along the line IIc-IIc of FIG. 2A. It should be noted that FIG. 2B and FIG. 2C omit illustration of the left half of the loudspeaker diaphragm, which is symmetrical to the right half thereof with respect to the center axis passing the point O, and that FIG. 2A has a scale different from scales of FIG. 2B and FIG. 2C. A loudspeaker diaphragm 200 further includes a gasket portion 30 bonded onto the outer peripheral portion of the edge portion 20.

The loudspeaker diaphragm according to the present invention is an integrally molded product. In other words, the above-mentioned diaphragm portion and the edge portion are integrated with each other without using an adhesive. Further, in a case where the loudspeaker diaphragm includes the gasket portion, the diaphragm portion, the edge portion, and the gasket portion may be integrated with one another without using an adhesive. With this configuration, it is possible to obtain a loudspeaker diaphragm which has less divided vibration and high bonding strength because respective members are firmly welded together. Further, there is no problem with a variation in adhesive application amount, and hence it is possible to obtain a loudspeaker diaphragm excellent in stability of quality. In addition, the number of components and man-hours can be reduced, and hence it is possible to obtain a loudspeaker and a loudspeaker diaphragm at low cost.

Figure 3:
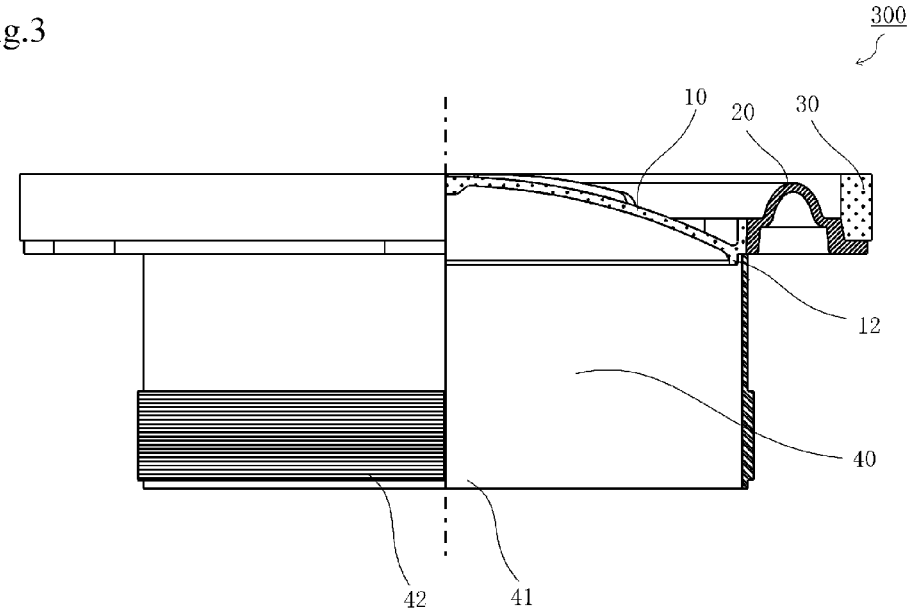
FIG. 3 is a schematic view of a loudspeaker according to a preferred embodiment of the present invention.
Figure 4:
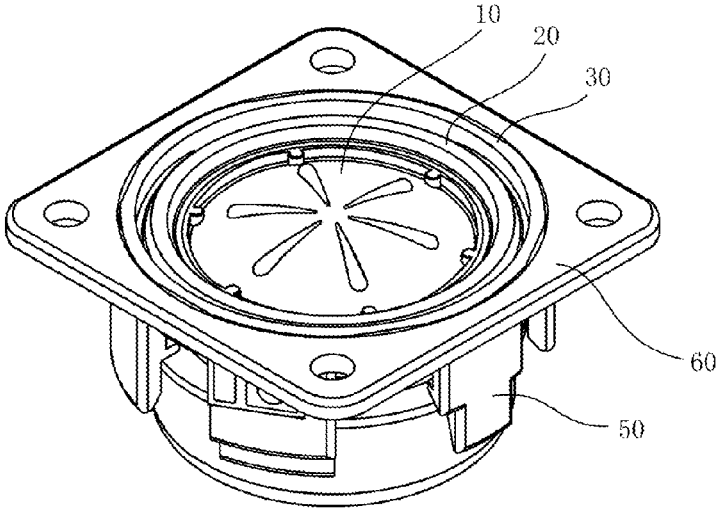
FIG. 4 is a schematic perspective view of a loudspeaker according to another preferred embodiment of the present invention.

FIG. 3 is a schematic view of a loudspeaker according to a preferred embodiment of the present invention. A left half of FIG. 3 schematically illustrates a side surface of the loudspeaker, and a right half thereof schematically illustrates a cross-section of the loudspeaker. A loudspeaker 300 includes the loudspeaker diaphragm 100 or 200 (loudspeaker diaphragm 200, in the illustrated example) and a voice coil 40. The voice coil 40 is fitted to the above-mentioned voice coil guide portion 12 of the loudspeaker diaphragm. The voice coil 40 preferably has a configuration in which a coil 42 is wound around a cylindrical bobbin 41. The end portion of the bobbin 41 is inserted into the voice coil guide portion 12 of the loudspeaker diaphragm, and is bonded using any appropriate adhesive (for example, rubber-based adhesive, epoxy-based adhesive, or ultraviolet curing adhesive). Note that, in a case where the loudspeaker diaphragm does not include the gasket portion, a gasket configured as a separate member may be bonded to the loudspeaker diaphragm, to thereby obtain a loudspeaker. Further, as illustrated in FIG. 4, the loudspeaker according to the present invention may practically include a magnetic circuit member 50 and a frame 60.

A-1. Diaphragm Portion

The above-mentioned diaphragm portion contains any appropriate resin. It is preferred to use, as the resin contained in the diaphragm portion, a resin excellent in adhesive property (welding property) with respect to a thermoplastic elastomer (described below) contained in the edge portion. This is because it is possible to obtain a high adhesive property when the diaphragm portion is molded integrally with the edge portion. Examples of the resin described above include a polyolefin-based thermoplastic resin. Specific examples of the polyolefin-based thermoplastic resin include polypropylene (PP), polyethylene (PE), poly(1-butene), polyisobutene, and polymethylpentene. They may be used alone or in combination. By using the resins described above, it is possible to obtain a lightweight loudspeaker diaphragm having an advantage in internal loss. The polypropylene is most preferred. This is because the polypropylene is excellent in balance of strength, lightness in weight, and versatility.

A solubility parameter of the resin contained in the above-mentioned diaphragm portion may be set depending on a kind of the thermoplastic elastomer contained in the edge portion. The resin contained in the diaphragm portion has a solubility parameter of preferably 7.8 $(J/cm^3)^{1/2}$ to 10 $(J/cm^3)^{1/2}$, more preferably 7.9 $(J/cm^3)^{1/2}$ to 8.2 $(J/cm^3)^{1/2}$.

The above-mentioned diaphragm portion may contain any appropriate additive. Examples of the additive include an inorganic filler and grain.

When the above-mentioned diaphragm portion contains the inorganic filler, it is possible to obtain a loudspeaker diaphragm excellent in heat resistance and strength. Specific examples of the inorganic filler include glass fiber and mica. The above-mentioned glass fiber has a fiber length of preferably 0.1 mm to 2 mm, more preferably 0.5 mm to 1 mm. Further, the glass fiber has a fiber diameter of preferably 3 μm to 24 μm, more preferably 5 μm to 10 μm.

Any appropriate grain is used as the above-mentioned grain. Specific examples of the grain include rice, corn, barley, wheat, rye, millet called as kibi, awa, or hie in Japanese, and sugarcane. They may be used alone or in combination. The rice is most preferred in the grain. As the rice, not only food rice but also non-food stock rice can be used. Use of the stock rice, i.e., surplus rice to be discarded, may have an advantage in production cost and environment.

Any appropriate shape may be adopted as the shape of the above-mentioned diaphragm portion. The diaphragm portion has preferably a dome shape. When the diaphragm portion has a dome shape, the voice coil may be arranged at a position close to the bonding portion between the diaphragm portion and the edge portion, and hence it is possible to obtain a loudspeaker diaphragm having less divided vibration.

A-2. Edge Portion

The above-mentioned edge portion contains preferably the thermoplastic elastomer. Examples of the thermoplastic elastomer include a styrene-based elastomer, a polyester-based elastomer, an olefin-based elastomer, and a urethane-based elastomer. The styrene-based elastomer is most preferred. This is because the styrene-based elastomer has a low hardness and an excellent elongation, and hence it is possible to obtain a loudspeaker diaphragm and a loudspeaker which have excellent linearity even at the time of large amplitude.

Specific examples of the above-mentioned styrene-based elastomer include a polystyrene-hydrogenated polybutadiene-polystyrene triblock copolymer, a polystyrene-hydrogenated polyisoprene-polystyrene triblock copolymer, a polystyrene-hydrogenated butadiene/isoprene copolymer-polystyrene triblock copolymer, a polystyrene-polyisobutene-polystyrene triblock copolymer, and a polystyrene-polyisobutylene-polystyrene triblock copolymer. They may be used alone or in combination.

The above-mentioned thermoplastic elastomer has a solubility parameter of preferably 8.1 $(J/cm^3)^{1/2}$ to 9.7 $(J/cm^3)^{1/2}$, more preferably 8.1 $(J/cm^3)^{1/2}$ to 8.5 $(J/cm^3)^{1/2}$.

The above-mentioned edge portion has a JIS-A hardness of preferably 0° to 70°, more preferably 15° to 60°, and particularly preferably 35° to 55°. With this range, it is possible to obtain a loudspeaker diaphragm and a loudspeaker which are excellent in linearity even at the time of large amplitude.

A material forming the above-mentioned edge portion has a tensile elongation at break (determined according to JIS-K 6251) of preferably 500% to 1000%. With this range, it is possible to obtain a loudspeaker diaphragm and a loudspeaker which are excellent in linearity even at the time of large amplitude.

A-3. Gasket Portion

The above-mentioned gasket portion contains any appropriate resin. As the resin contained in the gasket portion, there may be used a resin similar to the resin contained in the diaphragm portion described in the item "A-1". A material forming the gasket portion is preferably the same as the material forming the above-mentioned diaphragm portion.

B. Method of Producing Loudspeaker Diaphragm

The diaphragm portion and the edge portion of the loudspeaker diaphragm according to the present invention are produced by integral molding. More specifically, in the loudspeaker diaphragm according to the present invention, the diaphragm portion and the edge portion are made of different materials, and hence those members are molded integrally with each other by double molding. Thus, by undergoing the double molding, the different materials can be bonded to each other in a molten state to be firmly welded together, with the result that it is possible to obtain a loudspeaker diaphragm having high strength in the bonding portion and having less divided vibration. Further, an adhesive is not used, and hence there is no problem with a variation in adhesive application amount, and hence it is possible to obtain a loudspeaker diaphragm excellent in stability of quality. In addition, the number of components and man-hours can be reduced, and hence it is possible to obtain a loudspeaker and a loudspeaker diaphragm at low cost.

Any appropriate method may be adopted as a method of the above-mentioned double molding. In the above-mentioned double molding, the diaphragm portion may be molded in a primary molding and the edge portion may be molded in a secondary molding. Alternatively, the edge portion may be molded in the primary molding and the diaphragm portion may be molded in the secondary molding. Preferably, the diaphragm portion is molded in the primary molding and the edge portion is molded in the secondary molding. In the following, an embodiment in which the diaphragm portion is molded in the primary molding and the edge portion is molded in the secondary molding is described.

Figure 5A:
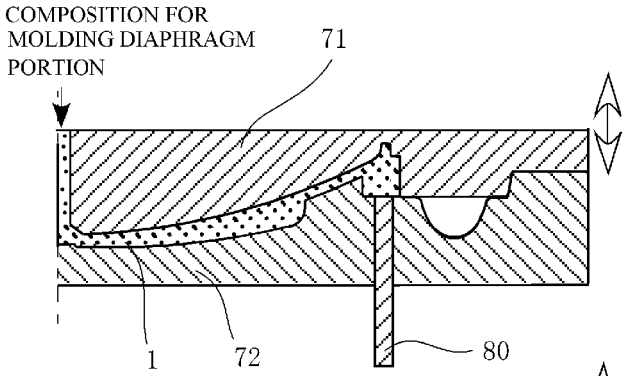
FIGS. 5A to 5C are schematic views schematically illustrating a method of producing the loudspeaker diaphragm according to the preferred embodiment of the present invention.
Figure 5B:
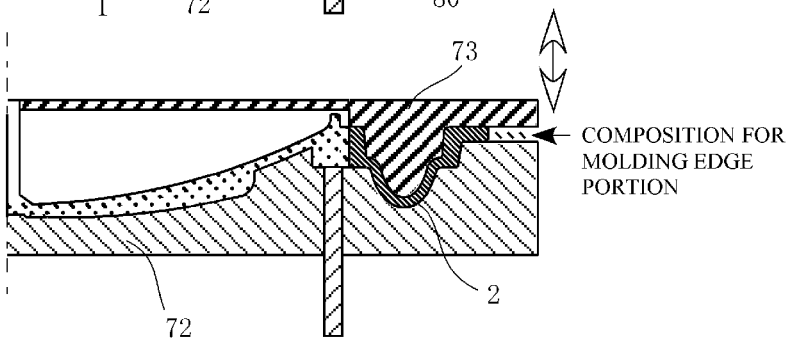
Figure 5C:
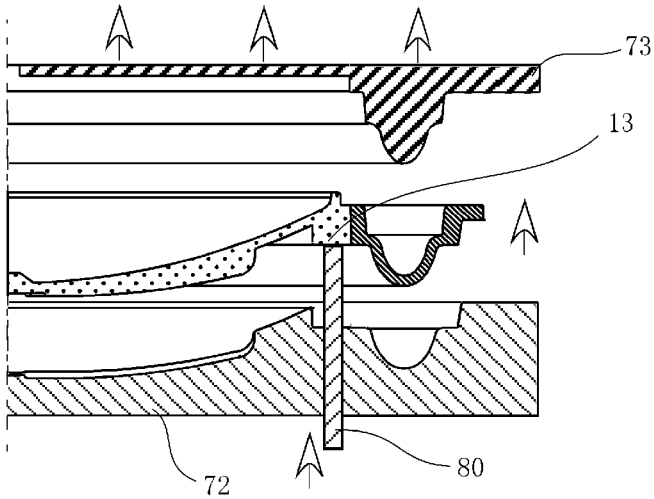

FIGS. 5A to 5C are schematic views schematically illustrating a method of producing the loudspeaker diaphragm according to the preferred embodiment of the present invention. FIG. 5A schematically illustrates a method of the primary molding in the producing method. FIG. 5B schematically illustrates a method of the secondary molding in the producing method. FIG. 5C schematically illustrates a method of taking a molded product (loudspeaker diaphragm) out of dies in the producing method. According to the producing method illustrated in FIGS. 5A to 5C, the loudspeaker diaphragm 100 illustrated in FIGS. 1A to 1C is obtained.

In the primary molding, as illustrated in FIG. 5A, a composition for molding a diaphragm portion is injected into a first cavity 1 which is formed by a first die 71 and a second die 72, for molding the diaphragm portion. Thus, the diaphragm portion is molded.

The second die 72 of the embodiment illustrated in FIGS. 5A to 5C has a through-hole formed therein. The second die 72 may have the plurality of through-holes formed therein (for example, six through-holes formed circularly at intervals of 60°). At the time of the primary molding and the secondary molding, into each of the through-holes, there is inserted an ejector pin 80 having the same diameter as that of the through-hole (for example, diameter of 0.6 mm). The through-hole is provided preferably at a position corresponding to the protruding portion 13 of the above-mentioned diaphragm portion 10, and the protruding portion 13 may have a surface on which the ejector pin 80 abuts.

The composition for molding a diaphragm portion contains the resin described in the item "A-1". A resin content of the composition for molding a diaphragm portion is preferably 45% by weight to 95% by weight, more preferably 55% by weight to 90% by weight, and particularly preferably 65% by weight to 80% by weight.

The above composition for molding a diaphragm portion may further contain the additive such as the inorganic filler or the grain described in the item "A-1" as needed. An inorganic filler content of the composition for molding a diaphragm portion is preferably 5% by weight to 55% by weight, more preferably 10% by weight to 35% by weight. A grain content of the composition for molding a diaphragm portion is preferably 10% by weight to 50% by weight, more preferably 20% by weight to 30% by weight.

A condition for injection molding performed in the primary molding can be set to any appropriate condition depending on a kind of the material.

In the secondary molding, as illustrated in FIG. 5B, after the first die 71 is released, a second cavity 2 is formed by a third die 73 and the second die 72 each shaped so as to conform to the edge portion. Then, a composition for molding an edge portion is injected into the second cavity 2, to thereby mold the edge portion.

The above-mentioned composition for molding an edge portion contains the thermoplastic elastomer described in the item "A-2". A thermoplastic elastomer content of the composition for molding an edge portion is preferably 20% by weight to 80% by weight, more preferably 40% by weight to 70% by weight.

The above-mentioned composition for molding an edge portion preferably further contains a polyolefin. Specific examples of the polyolefin include polyethylene, polypropylene, an ethylene/propylene copolymer, a propylene/4-methyl-1-pentene copolymer, poly(4-methyl-1-pentene), and polybutene-1. Polystyrene may be used in combination with the polyolefin for the purpose of improving workability and heat resistance.

With respect to 100 parts by weight of the above-mentioned thermoplastic elastomer, a polyolefin content of the above-mentioned composition for molding an edge portion is preferably 2 parts by weight to 20 parts by weight, more preferably 5 parts by weight to 20 parts by weight.

The above-mentioned composition for molding an edge portion preferably further contains a polybutene. A structural unit of the polybutene may be n-butene or isobutane, and the polybutene may be an isobutane/n-butene copolymer containing isobutane as a main component.

With respect to 100 parts by weight of the above-mentioned thermoplastic elastomer, a polybutene content of the above-mentioned composition for molding an edge portion is preferably 70 parts by weight or less, more preferably 15 parts by weight to 35 parts by weight.

The above-mentioned composition for molding an edge portion preferably further contains an oil. Specific examples of the oil include a paraffinic oil, a naphthenic oil, a silicone oil, an aromatic oil, and a vegetable oil.

With respect to 100 parts by weight of the above-mentioned thermoplastic elastomer, an oil content of the above-mentioned composition for molding an edge portion is preferably 70 parts by weight to 300 parts by weight, more preferably 70 parts by weight to 270 parts by weight.

The above-mentioned composition for molding an edge portion may contain any appropriate additive. Examples of the additive include a pigment, a flame retardant, an anti-aging agent, an antistatic agent, an antibacterial agent, an antioxidant, an inorganic hollow filler, an inorganic filler, an organic filler, a release agent, a light stabilizer, a tackifier, and an adhesive elastomer. The number, kinds, and amount of the additives may be appropriately selected depending on purposes.

As the above-mentioned composition for molding an edge portion, a commercially available product may be used. Specific examples of the commercially available product include products available under the trade names "ER830" and "ER545" from Bridgestone Corporation.

A condition for injection molding performed in the secondary molding can be set to any appropriate condition depending on a kind of the material.

After the secondary molding, the molded product (loudspeaker diaphragm) is taken out of the dies. Specifically, as illustrated in FIG. 5C, after the third die 73 is released, the ejector pin 80 which abuts on the protruding portion 13 of the diaphragm portion 10 is pushed up, and thus the molded product (loudspeaker diaphragm) can be released from and taken out of the second die 72.

Figure 6A:
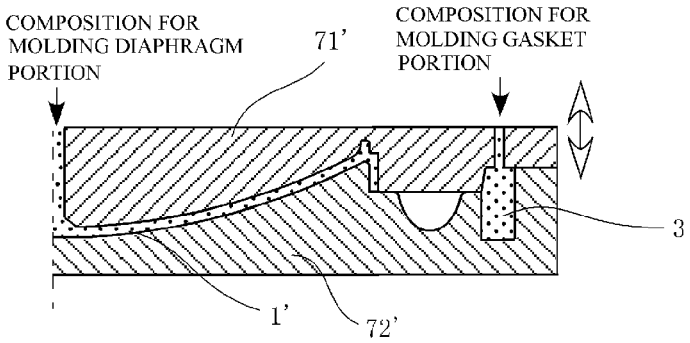
FIGS. 6A to 6C are schematic views schematically illustrating a method of producing the loudspeaker diaphragm according to the another preferred embodiment of the present invention.
Figure 6B:
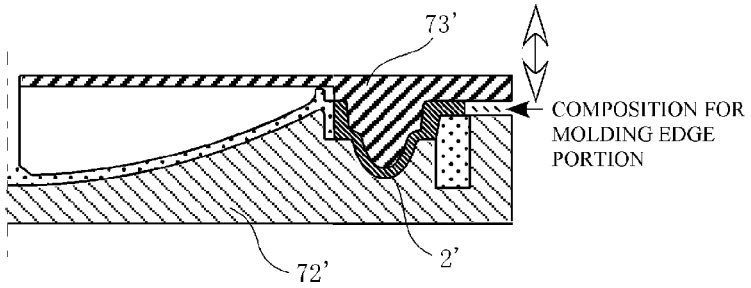
Figure 6C:
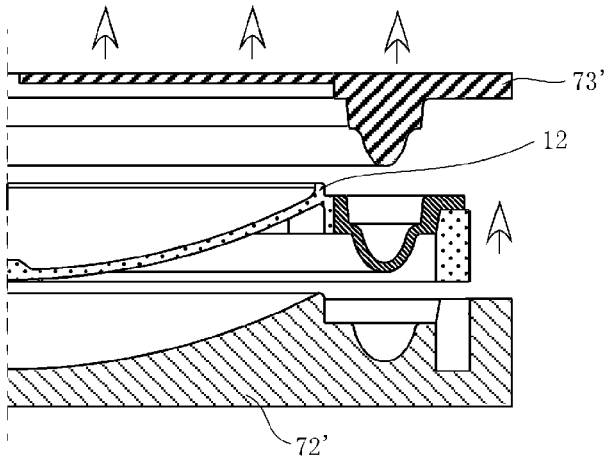

FIGS. 6A to 6C are schematic views schematically illustrating a method of producing the loudspeaker diaphragm according to the another preferred embodiment of the present invention. FIG. 6A schematically illustrates a method of the primary molding in the producing method. FIG. 6B schematically illustrates a method of the secondary molding in the producing method. FIG. 6C schematically illustrates a method of taking a molded product (loudspeaker diaphragm) out of dies in the producing method. The loudspeaker diaphragm produced by the producing method includes the gasket portion. In the producing method, a third cavity 3 for forming the gasket portion is further formed by a first die 71' and a second die 72'.

In a case where the loudspeaker diaphragm according to the present invention includes the gasket portion, the diaphragm portion, the edge portion, and the gasket portion may be molded integrally with one another (molded by double molding in a case where, for example, the diaphragm portion and the gasket portion are made of the same material). In the case where the loudspeaker diaphragm according to the present invention includes the gasket portion, the diaphragm portion and the gasket portion are preferably made of the same material, and as illustrated in FIG. 6A and FIG. 6B, the diaphragm portion and the gasket portion are molded in the primary molding and the edge portion is molded in the secondary molding.

EXAMPLES

In the following, the present invention is described in further detail with reference to Examples, but the present invention is not limited to Examples. Note that, all parts and percentages stated in Examples are based on weight unless stated otherwise.

Example 1

A loudspeaker diaphragm was produced according to the producing method illustrated in FIGS. 6A to 6C.

1. Primary Molding

The first die 71' and the second die 72' having cross-sectional shapes illustrated in FIGS. 6A to 6C were used (both the dies have an outermost diameter Φ of 19.2 mm). In a first cavity 1' (diaphragm portion) and the third cavity 3 (gasket portion) formed by the dies, the diaphragm portion and the gasket portion were molded using a molding composition having a composition shown in Table 1 (FIG. 6A).

TABLE 1

| (Primary molding composition) | |
|---|---|
| Polypropylene resin | 70 parts |
| Mica | 25 parts |
| Carbon black | 5 parts |

2. Secondary Molding

After the first die 71' was released, a second cavity 2' was formed by the second die 72' and a third die 73'. In the second cavity 2', the edge portion was molded using the composition for molding an edge portion (FIG. 6B). Then, the molded product was taken out of the dies (FIG. 6C), and thus a loudspeaker diaphragm having a height of 1.8 mm was obtained. As the composition for molding an edge portion, a super-low-hardness styrene-based thermoplastic elastomer composition (manufactured by Bridgestone Corporation: JIS-A hardness 35°) was used.

3. Assembly of other Members

A voice coil was inserted in and bonded to a portion (voice coil guide portion 12) situated directly below the bonding portion between the diaphragm portion and the edge portion of the loudspeaker diaphragm obtained by the above-mentioned molding.

In addition, a frame and a magnetic circuit member were assembled using a jig, and thus a loudspeaker having a diameter Φ of 20 mm was obtained.

Example 2

A loudspeaker diaphragm and a loudspeaker were obtained in a similar way to that of Example 1, except that the primary molding composition having a composition shown in Table 2 was used.

TABLE 2

| (Primary molding composition) | |
|---|---|
| Resin pellet (manufactured by Biomass Technology Co., Ltd., trade name "BT Pellet SRP70-3F"), which is obtained by mixing a polypropylene resin and non-food stock rice in a weight ratio of 30:70 | 36 parts |
| Resin pellet (manufactured by Daicel Polymer Ltd., trade name "PLASTRON PP-GF50-01"), which is obtained by mixing a polypropylene resin and long glass fiber (having a fiber length of 1 mm to 2 mm) in a weight ratio of 50:50 | 20 parts |
| Block polypropylene (manufactured by Prime Polymer Co., Ltd., trade name "Prime Polypro") | 37 parts |
| Deodorant masterbatch containing 10% of calcium stearate | 5 parts |
| Water repellent masterbatch containing 10% of silicone | 2 parts |

Comparative Example 1

Figure 7:
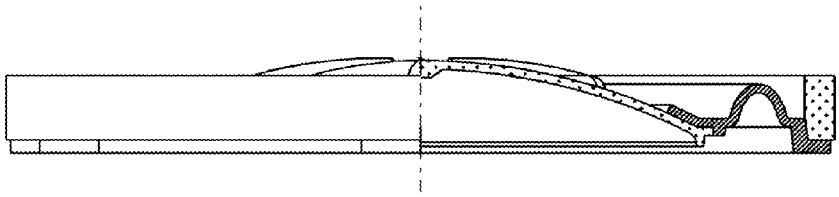
FIG. 7 is a schematic cross-sectional view of a loudspeaker diaphragm obtained in Comparative Example 1.

As illustrated in FIG. 7, a loudspeaker diaphragm was obtained in a similar way to that of Example 1, except that the diaphragm portion did not include the outer wall portion and a direction of the bonding portion between the diaphragm portion and the edge portion was along the diaphragm portion. Using the loudspeaker diaphragm thus obtained, a loudspeaker was obtained in a similar way to that of Example 1.

Comparative Example 2

Paper was used as a material for forming the diaphragm portion, and coated fabric was used as a material for forming the edge portion. After molded into substantially the same shapes as those of Example 1, the diaphragm portion and the edge portion were bonded to each other using an adhesive, and thus a loudspeaker diaphragm was obtained. Then, in a similar way to that described in the section "3. Assembly of other members" of Example 1, a loudspeaker having a diameter Φ of 20 mm was obtained.

<Evaluation>

1. Sound Pressure Frequency Characteristics

Figure 8:
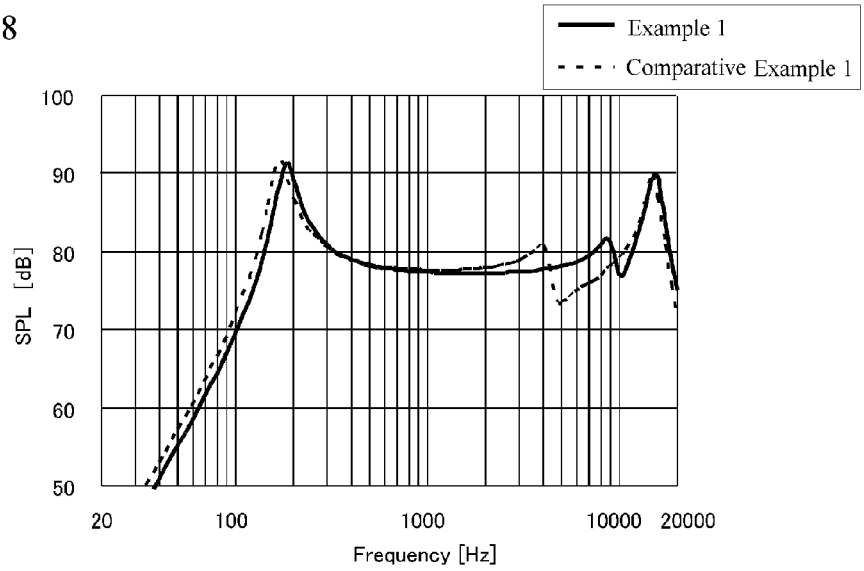
FIG. 8 is a graph showing sound pressure frequency characteristics of loudspeakers obtained in Example 1 and Comparative Example 1.
Figure 9:
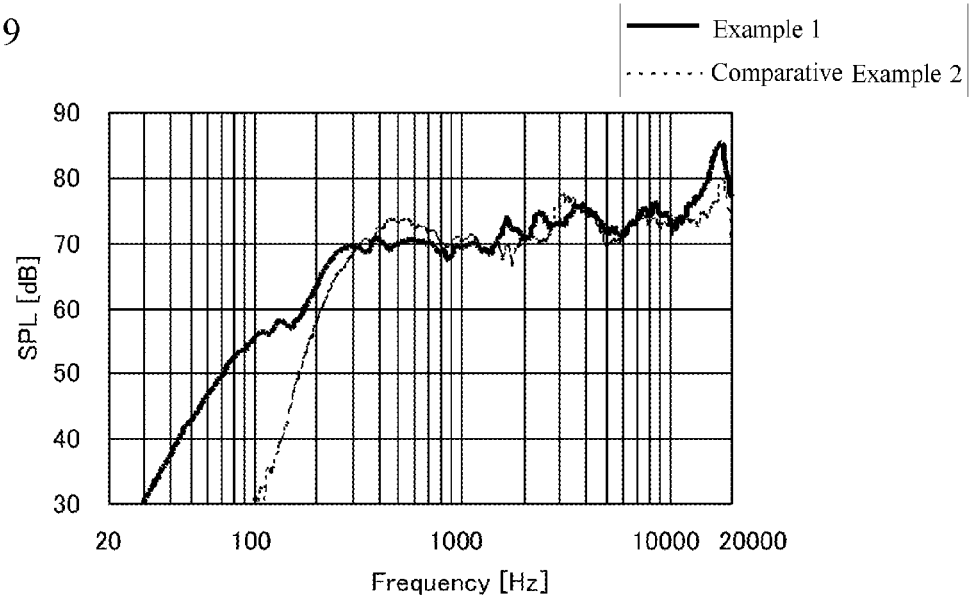
FIG. 9 is a graph showing sound pressure frequency characteristics of loudspeakers obtained in Example 1 and Comparative Example 2.

A vibration simulation using a finite element method was performed on the loudspeakers obtained in Example 1 and Comparative Example 1, and then sound pressure frequency characteristics of the loudspeakers were evaluated. The results are shown in FIG. 8. Further, sound pressure frequency characteristics of the loudspeakers obtained in Example 1 and Comparative Example 2 were measured and evaluated. The results are shown in FIG. 9.

2. Load-displacement Characteristics

Regarding the loudspeaker diaphragms obtained in Example 1 and Comparative Example 2, displacement characteristics with respect to load were evaluated. The results are shown in FIG. 10.

As is apparent from FIG. 8, the loudspeaker of Example 1 using the loudspeaker diaphragm according to the present invention shows sound pressure frequency characteristics that are almost flat as compared to the case of Comparative Example 1. Meanwhile, regarding the loudspeaker of Comparative Example 1 using the loudspeaker diaphragm in which the diaphragm portion and the edge portion are bonded to each other along the diaphragm portion, a large drop is seen at the vicinity of about 2 kHz. The loudspeaker diaphragm according to the present invention has high strength at the bonding portion between the diaphragm portion and the edge portion in the vibrating direction, and hence can obtain such excellent characteristics. Meanwhile, in the case of Comparative Example 1, the strength at the bonding portion between the diaphragm portion and the edge portion is lowered with respect to the vibrating direction, and hence antiresonance in the diaphragm portion and the edge portion is likely to occur.

Further, as shown in FIG. 9, even if having a small diameter, the loudspeaker of Example 1 using the loudspeaker diaphragm according to the present invention can obtain excellent characteristics in a low frequency range. The loudspeaker of Example 1 shows a sound pressure level higher than that of the loudspeaker of Comparative Example 2 in a range of a lowest resonance frequency f0 (=about 300 Hz) or less.

Figure 10:
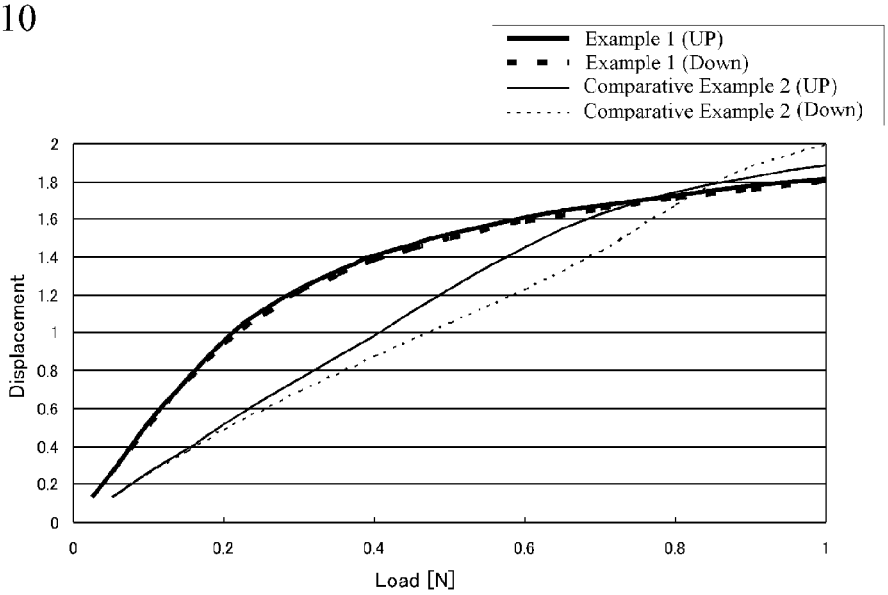
FIG. 10 is a graph showing displacement characteristics with respect to load of loudspeaker diaphragms obtained in Example 1 and Comparative Example 2.

The thermoplastic elastomer having a super-low hardness and an excellent elongation is used for the edge portion of the loudspeaker diaphragm according to the present invention, and hence it is possible to obtain excellent linearity even at the time of large amplitude when large load is applied as shown in FIG. 10.

The loudspeaker diaphragm according to the present invention and the loudspeaker using the same may be suitably used for various purposes, and may be suitably used particularly for a compact loudspeaker for portable electronic devices (for example, laptop computer, mobile phone, and portable music player).

What is claimed is:

1. A loudspeaker diaphragm, comprising:

a diaphragm portion; and an edge portion, which is molded integrally with the diaphragm portion and made of a material different from a material for the diaphragm portion, wherein:

the diaphragm portion comprises, at an outer peripheral end thereof, an outer wall portion provided upright in a direction substantially parallel to a vibrating direction of the diaphragm portion;

an inner peripheral surface of the edge portion is bonded onto an outer peripheral surface of the outer wall portion; and the outer wall portion has a height larger than a thickness of the diaphragm portion, wherein:

the outer wall portion comprises a protruding portion protruding in a radial direction; and the protruding portion comprises a plurality of protruding portions provided at substantially equal intervals in a circumferential direction of the outer wall portion.

2. A loudspeaker diaphragm according to claim 1, wherein the diaphragm portion comprises a voice coil guide portion extending below the outer wall portion.

3. A loudspeaker, comprising:

the loudspeaker diaphragm according to claim 2; and a voice coil fitted to the voice coil guide portion.

4. A loudspeaker diaphragm according to claim 1, wherein the diaphragm portion comprises a polyolefin-based thermoplastic resin and one of an inorganic filler and grain.

5. A loudspeaker diaphragm according to claim 1, wherein the edge portion has a JIS-A hardness of 0° to 70°.

6. A loudspeaker diaphragm according to claim 1, further comprising a gasket portion which is made of the same material as the material for the diaphragm portion and molded integrally with and bonded to an outer peripheral portion of the edge portion.

7. A loudspeaker diaphragm according to claim 1, wherein the diaphragm portion and the edge portion are obtained by being molded integrally with each other by double molding.

* * * * *